US007794286B2

(12) United States Patent
AbuGhazaleh et al.

(10) Patent No.: US 7,794,286 B2
(45) Date of Patent: Sep. 14, 2010

(54) ELECTRICAL CONNECTOR WITH SEPARATE CONTACT MOUNTING AND COMPENSATION BOARDS

(75) Inventors: Shadi A. AbuGhazaleh, Oakdale, CT (US); Joseph E. Dupuis, Ledyard, CT (US); Naved S. Khan, Portland, CT (US); Christopher W. Gribble, Westerly, RI (US); Douglas P. O'Connor, Richmond, RI (US)

(73) Assignee: Hubbell Incorporated, Shelton, CT (US)

( * ) Notice: Subject to any disclaimer, the term of this patent is extended or adjusted under 35 U.S.C. 154(b) by 110 days.

(21) Appl. No.: 12/314,613

(22) Filed: Dec. 12, 2008

(65) Prior Publication Data

US 2010/0151707 A1 Jun. 17, 2010

(51) Int. Cl.
*H01R 12/00* (2006.01)

(52) U.S. Cl. ..... 439/676

(58) Field of Classification Search ..... 439/676, 439/76.1, 620.11, 620.18, 941
See application file for complete search history.

(56) References Cited

U.S. PATENT DOCUMENTS

| | | | |
|---|---|---|---|
| 4,988,550 | A | 1/1991 | Keyser et al. |
| 5,547,405 | A | 8/1996 | Pinney et al. |
| 5,573,857 | A | 11/1996 | Auger |
| 6,116,964 | A | 9/2000 | Goodrich et al. |
| 6,120,329 | A | 9/2000 | Steinman |
| 6,165,023 | A | 12/2000 | Troutman et al. |
| 6,305,950 | B1 | 10/2001 | Doorhy |
| 6,332,810 | B1 | 12/2001 | Bareel |
| 6,350,158 | B1 | 2/2002 | Arnett et al. |
| 6,443,777 | B1 | 9/2002 | McCurdy et al. |
| 6,582,250 | B2 | 6/2003 | Taylor et al. |
| 6,629,862 | B2 | 10/2003 | Schmidt et al. |
| 6,729,914 | B2 | 5/2004 | Jaouen |
| 6,743,052 | B1 | 6/2004 | Lin et al. |
| 6,776,667 | B2 | 8/2004 | Funatsu et al. |
| 6,786,776 | B2 | 9/2004 | Itano et al. |
| 6,799,997 | B2 | 10/2004 | Lin et al. |
| 6,840,779 | B2 * | 1/2005 | Eberle et al. ..... 439/76.1 |
| 6,840,816 | B2 | 1/2005 | Aekins |
| 6,974,352 | B2 | 12/2005 | Clark et al. |
| 6,994,594 | B2 | 2/2006 | Milner et al. |
| 7,074,092 | B1 | 7/2006 | Green et al. |
| 7,153,168 | B2 | 12/2006 | Caveney et al. |
| 7,179,131 | B2 | 2/2007 | Caveney et al. |
| RE39,546 | E | 4/2007 | Phommachanh |

(Continued)

*Primary Examiner*—Alexander Gilman
(74) *Attorney, Agent, or Firm*—Mark S. Bicks; Alfred N. Goodman

(57) ABSTRACT

An electrical connector includes a housing having a plug receiving cavity with an open end for receiving a plug and with an inner end spaced from the open end, and having a forward chamber outside of the cavity and adjacent the open end. A mounting circuit board is in the housing adjacent the inner end. A plurality of pairs of electrical jack contacts have mounting ends engaging the mounting circuit board, plug contacting portions extending through the cavity from the mounting end toward the open end, and free ends extending from the contacting portion into the forward chamber. A compensation circuit board is mounted in the forward chamber of the housing outside of the plug receiving cavity, and has a compensation circuit with conductive pads. The free ends of the jack contacts engage the conductive pads. A spring in the forward chamber biases the compensation circuit board towards the free ends of the jack contacts.

24 Claims, 14 Drawing Sheets

U.S. PATENT DOCUMENTS 7,249,974 B2 7/2007 Gordon et al.
7,252,554 B2 8/2007 Caveney et al.
7,273,396 B2 9/2007 Itano et al.
7,281,957 B2 10/2007 Caveney
7,285,025 B2 10/2007 Denovich et al.
7,309,261 B2 12/2007 Caveney et al.
7,637,780 B2 * 12/2009 Schoene et al. ..... 439/620.11
7,674,136 B2 * 3/2010 Steinke et al. ..... 439/676
2004/0203292 A1 * 10/2004 Eberle et al. ..... 439/676
2005/0042922 A1 2/2005 Haller et al.
2006/0134995 A1 6/2006 Bolouri-Saransar et al.
2006/0185884 A1 8/2006 Ortiz et al.
2007/0015417 A1 1/2007 Caveney et al.
2007/0082540 A1 4/2007 Mullin et al.
2007/0117469 A1 * 5/2007 Caveney et al. ..... 439/676
2007/0178772 A1 8/2007 Hashim et al.
2007/0190863 A1 8/2007 Caveney et al.
2007/0212945 A1 9/2007 Wang et al.
2007/0243728 A1 10/2007 Ellis et al.
2007/0270043 A1 11/2007 Pepe et al.
2007/0270044 A1 11/2007 Belopolsky et al.
2008/0020652 A1 * 1/2008 Caveney et al. ..... 439/676
2008/0045090 A1 * 2/2008 Caveney ..... 439/676
2008/0166925 A1 * 7/2008 Caveney et al. ..... 439/676
2009/0227151 A1 * 9/2009 Caveney ..... 439/676

* cited by examiner

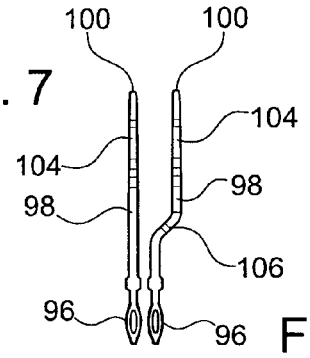
FIG. 7
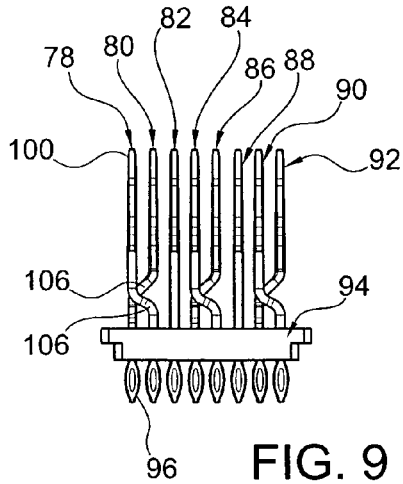
FIG. 8
FIG. 9
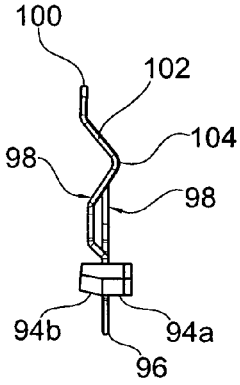
FIG. 11
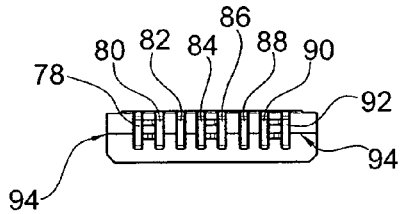
FIG. 10
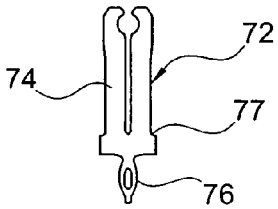
FIG. 12
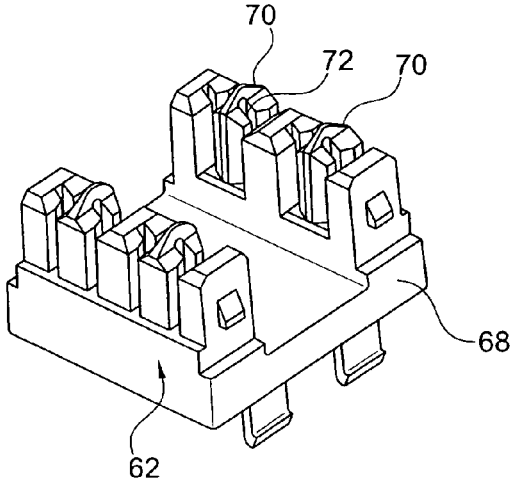
FIG. 13

FIG. 33A
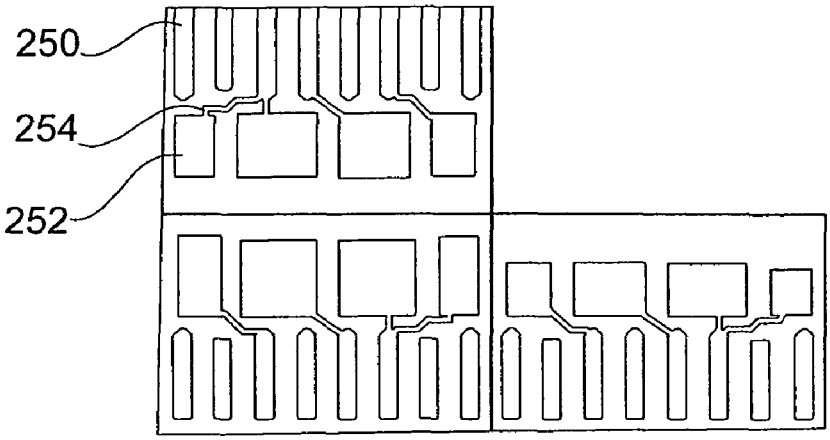
FIG. 33B FIG. 33C
FIG. 34A
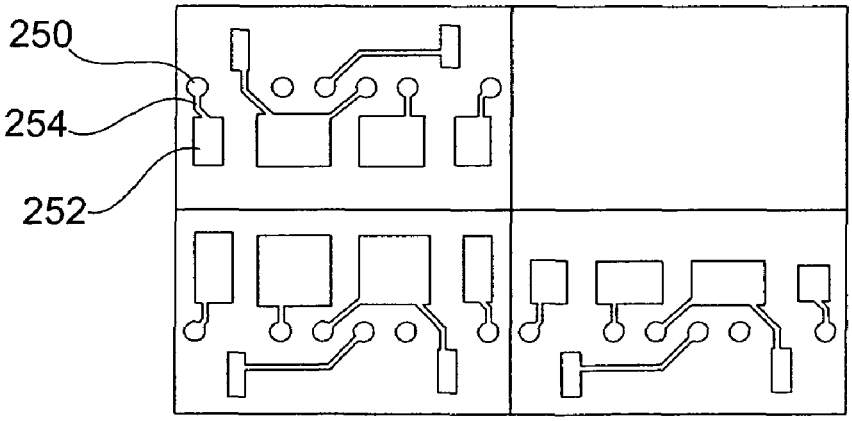
FIG. 34B FIG. 34C

FIG. 38
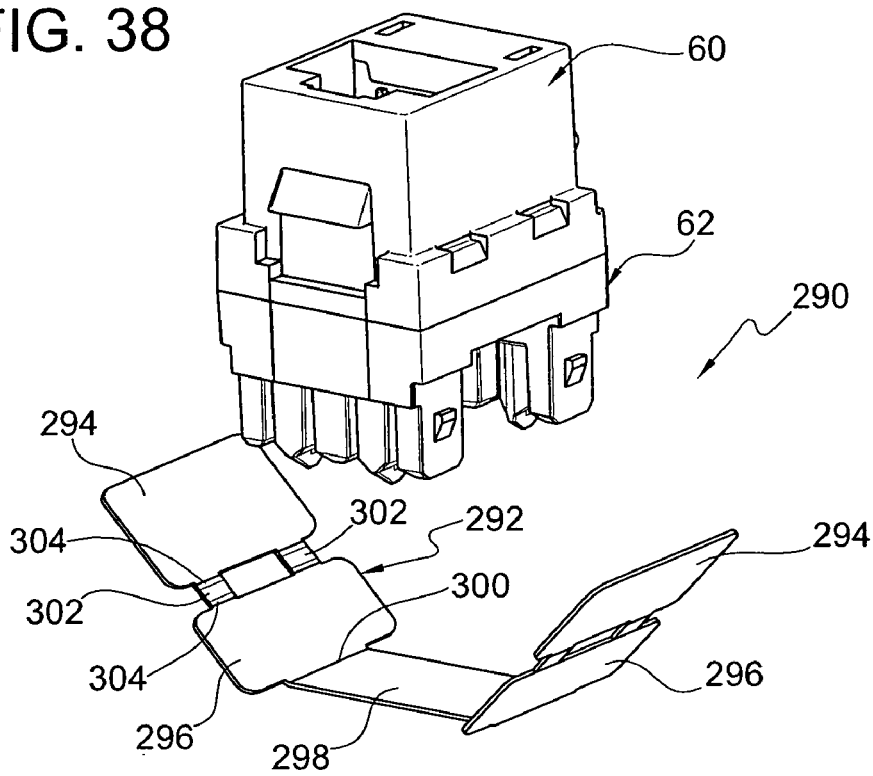
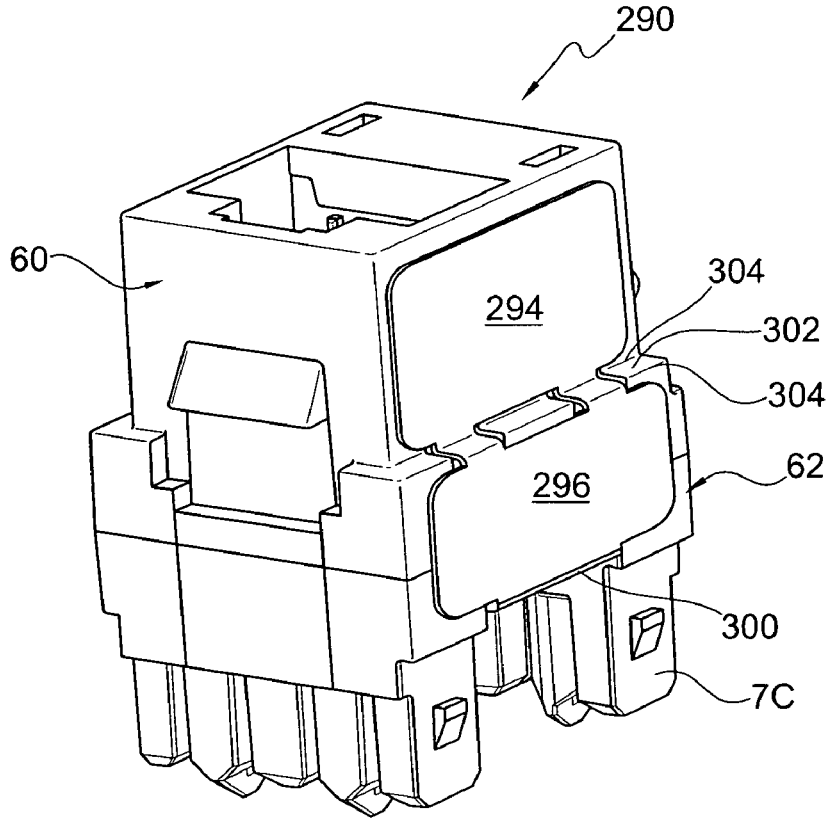
FIG. 39

ELECTRICAL CONNECTOR WITH SEPARATE CONTACT MOUNTING AND COMPENSATION BOARDS

REFERENCE TO RELATED APPLICATIONS

This application is related to application Ser. No. 12/285,428 of Shadi A. AbuGhazaleh and Douglas P. O'Connor, filed Oct. 3, 2008 and entitled Crosstalk Prevention Cover, the subject matter of which is hereby incorporated by reference.

FIELD OF THE INVENTION

The present invention relates to an electrical connector, particularly for telecommunication systems in which crosstalk induced between adjacent contacts or terminals of the connectors is cancelled. The cancellation of crosstalk is effected by compensation circuits coupled to the contacts or terminals of the connector, with compensation circuits located on a board separate from the board for mounting the contacts and biased against free ends of the contacts.

BACKGROUND OF THE INVENTION

Due to advancements in telecommunications and data transmissions speeds over balanced, twisted-pair cables, the connectors (such as jacks, plugs, patch panels, cross connects, etc.) are a critical impediment to high performance data transmission at higher frequencies. Performance characteristics, particularly crosstalk and return loss, degrade beyond acceptable levels at higher frequencies. This degredation is particularly true for operation at category 6 and category 6a levels.

When an electric signal is carried on the signal line, which is in close proximity of another signal line or lines carrying a signal or signals, such as in the case of adjacent pins of contacts in the connector, energy from one signal line can be coupled onto adjacent signal line by the electric field generated by the potential between the two signal lines and the magnetic field generated as a result of the changing electrical fields. This coupling, whether capacitive or inductive, is called crosstalk when this phenomenon occurs between two or more signal lines.

Crosstalk is a noise signal and degenerates the signal-to-noise margin or ratio (SIN) of the system. In telecommunication systems, reduced S/N margins result in greater error rates in the information conveyed in the signal line. Depending on the category of the system, the S/N margin must satisfy set performance criteria.

Crosstalk problems could be overcome by increasing the spacing between the signal lines, or by shielding the individual signal lines. In many cases, the wiring is preexisting and standards define the geometries and pin definitions for connectors, making the necessary changes to such systems cost prohibited. In this specific case of communication systems using balanced, twisted-pair wiring, standards defining connector geometries and pin out definitions are in effect, but were created prior to the need for high speed data communications.

These standards have created a large base of wiring and connectors and a need for connectors capable of meeting the requirements of high speed communications, while maintaining compatibility with the original connectors. The standard connector geometries and pin outs are such that a great deal of crosstalk occurs at higher signal frequencies.

Numerous connector constructions have been developed to alleviate this crosstalk problem. Such systems involve counteracting a noise signal in a line by inducing in that line a signal equal to and opposite to the noise signal such that the induced noise signal is effectively cancelled by the induced correction signal. Examples of such connectors are disclosed in U.S. Pat. Nos. 5,432,484, 5,673,009 and 6,796,847, the subject matter of each of which is hereby incorporated by reference.

The distance from the circuitry providing the compensation for the crosstalk to the point of engagement of the plug contacts and the jack contacts has been determined to be significant in the effectiveness of reducing crosstalk. Such distances are to be made as small as possible. The distance between the plug contact-jack contact engagement point to the compensation circuitry also needs to be maintained constant, as well as as small as possible, to maintain consistent performance. Additionally, the jack contacts must remain in place despite flexing to avoid inadvertent contact with the other jack contacts or improper contact with the plug contacts. The resilient jack contacts must maintain their resiliency, and must not be overstressed by the deformation caused by engagement with the plug.

As used in this application, the terms "top", "bottom", "side", "front", "rear" and the like are intended to facilitate the description of the electrical connector and parts thereof. Such terms are merely illustrative of the connector and its parts, and are not intended to limit the electrical connector and its parts to any specific orientation.

SUMMARY OF THE INVENTION

An object of the present invention is to provide an electrical connector having a primary or mounting circuit board from which the jack contacts extend and a secondary or compensation circuit board flexibly mounted in the connector housing outside of the plug receiving cavity.

Another object of the present invention is to provide an electrical connector, particularly for communication systems, effectively cancelling crosstalk induced across connector terminals even at very high transmission frequencies.

A further object of the present invention is to provide an electrical connector with reduced crosstalk at high transmission speeds or frequencies without internal shielding between its individual contacts or without changing the standard connector geometry and pin out definitions.

A still further object of the present invention is to provide an electrical connector with reduced crosstalk that is simple and inexpensive to manufacture and use.

Yet another object of the present invention is to provide an electrical connector wherein the distance between the engagement point of the jack contacts and plug contacts to the compensation circuitry is effectively reduced.

The foregoing objects are basically obtained by an electrical connector comprising a housing, a mounting circuit board, a plurality of pairs of electrical jack contacts, a compensation circuit board, and a spring. The housing has a plug receiving cavity with an open end for receiving a plug and with an inner end spaced from the open end, and has a forward chamber outside of the cavity and adjacent the open end. The mounting circuit board is in the housing adjacent the inner end. Each of the jack contacts has a mounting end engaging the mounting circuit board, a plug contacting portion extending through the cavity from the mounting end toward the open end, and a free end extending from the contacting portion into the forward chamber. The compensation board is mounted in the forward chamber of the housing outside of the plug receiving cavity, and has a compensating circuit thereon with conductive pads. The free ends of the jack contact engage the conductive paths. The spring is located in the forward chamber to bias the compensation board towards the free ends of the jack contacts.

By forming the electrical connector in this manner, the distance between the compensating circuitry on the compensation circuit board and the engagement point between the jack contact and the plug contact, and the biasing of the compensation board improves electrical performance. This performance is improved by shortening the distance from the plug engagement point to the crosstalk compensation provided by the compensating circuit on the compensation circuit board. As the jack contacts are deflected by insertion of the plug into the plug receiving cavity, the individual jack contacts are forced to sweep or slide along the conductive pads on the compensation circuit board providing a wiping action to enhance the electrical connection therebetween. The spring biasing the compensation circuit board allows the compensation circuit board to move within the housing in response to the insertion of the plug in a manner to reduce stress in the jack contact structure while providing a reliable mechanical and electrical connection.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 7 is a top plan view of one of the jack contacts of the electrical connector of FIG. 1;

FIG. 8 is a top plan view of another jack contact of the electrical connector of FIG. 1;

FIG. 9 is a top plan view of the jack contacts secured in an over mold of the electrical connector of FIG. ;

FIG. 10 is a front elevational view of the jack contacts and over mold of FIG. 9;

FIG. 11 is a side elevational view of the jack contacts and over mold of FIG. 9;

FIG. 12 is a front elevational view of an insulation displacement contact of the electrical connector of FIG. 1;

FIG. 13 is a perspective view of an insulator housing for the insulation displacement contacts of the electrical connector of FIG. 1;

FIGS. 33A-C and FIGS. 34A-C are top plan views of first and second electrical layers, respectively, of the compensation circuit board of the electrical connector of FIG. 1, diagrammatically illustrating three different compensation circuit arrangements;

FIG. 38 is an exploded perspective view of an electrical connector according to a fourth exemplary embodiment according to the present invention; and FIG. 39 is a perspective view of the electrical connector of FIG. 38, as assembled.

DETAILED DESCRIPTION OF THE INVENTION

Figure 1:
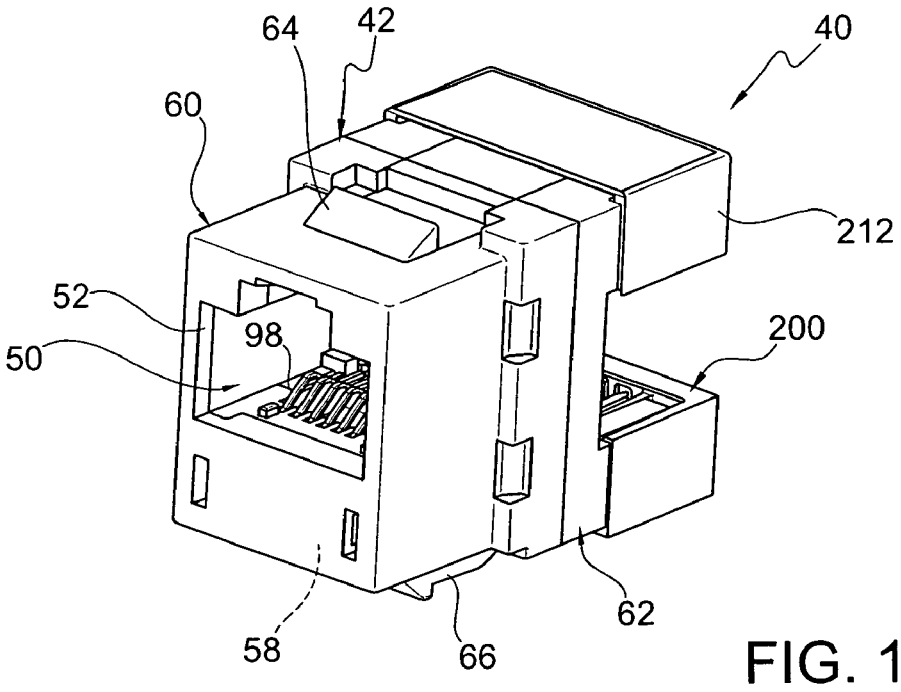
FIG. 1 is a perspective view of an electrical connector in accordance with a first exemplary embodiment of the present invention.
Figure 2:
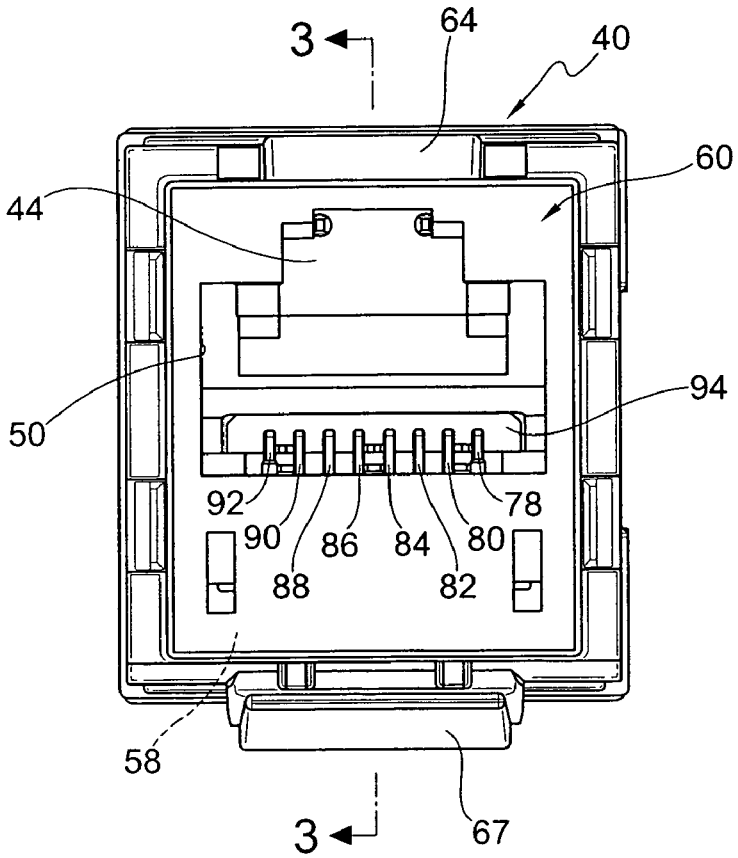
FIG. 2 is a front elevational view of the electrical connector of FIG. 1.

According to a first exemplary embodiment of the present invention, the electrical connector 40 is in the form of a communications and/or data transmission jack. The connector has a housing 42, a mounting circuit board 44, a compensation circuit board 46 and a spring 48 for biasing the compensation circuit board. The housing has a plug receiving cavity 50 with an open end 52 for receiving a plug 54, and an inner end 56 spaced from open end 52. A forward chamber 58 is located within the housing outside of cavity 50 and adjacent to open end 52, and receives compensation circuit board 46. The mounting circuit board 44 is mounted in the housing adjacent inner end 56. A plurality of pairs of electrical jack contacts are arranged in the housing and engage the compensation circuit board, as will be explained hereinafter.

Housing 42 comprises a nose housing part 60 and an insulator housing part 62. These two housing parts can be coupled to one another in any suitable and conventional fashion, including ultrasonic welding and resilient latch connections.

While each of the two parts is formed separately, they are secured to one another such that they are not readily detachable.

Nose housing part 60 has a substantially parallelepiped shape, and comprises a forwardly tapered abutment 64 on its top outer surface and a forwardly extending resilient latch arm 66 extending from its rear end adjacent to, spaced from and parallel to its outer bottom surface. The forward end of latch arm 66 has a forwardly tapered abutment 67. Abutment 64 and latch arm 66 facilitate connection of electrical connector 40 in an outlet or receptacle face plate, a patch panel or other suitable mounting structure.

Figure 4:
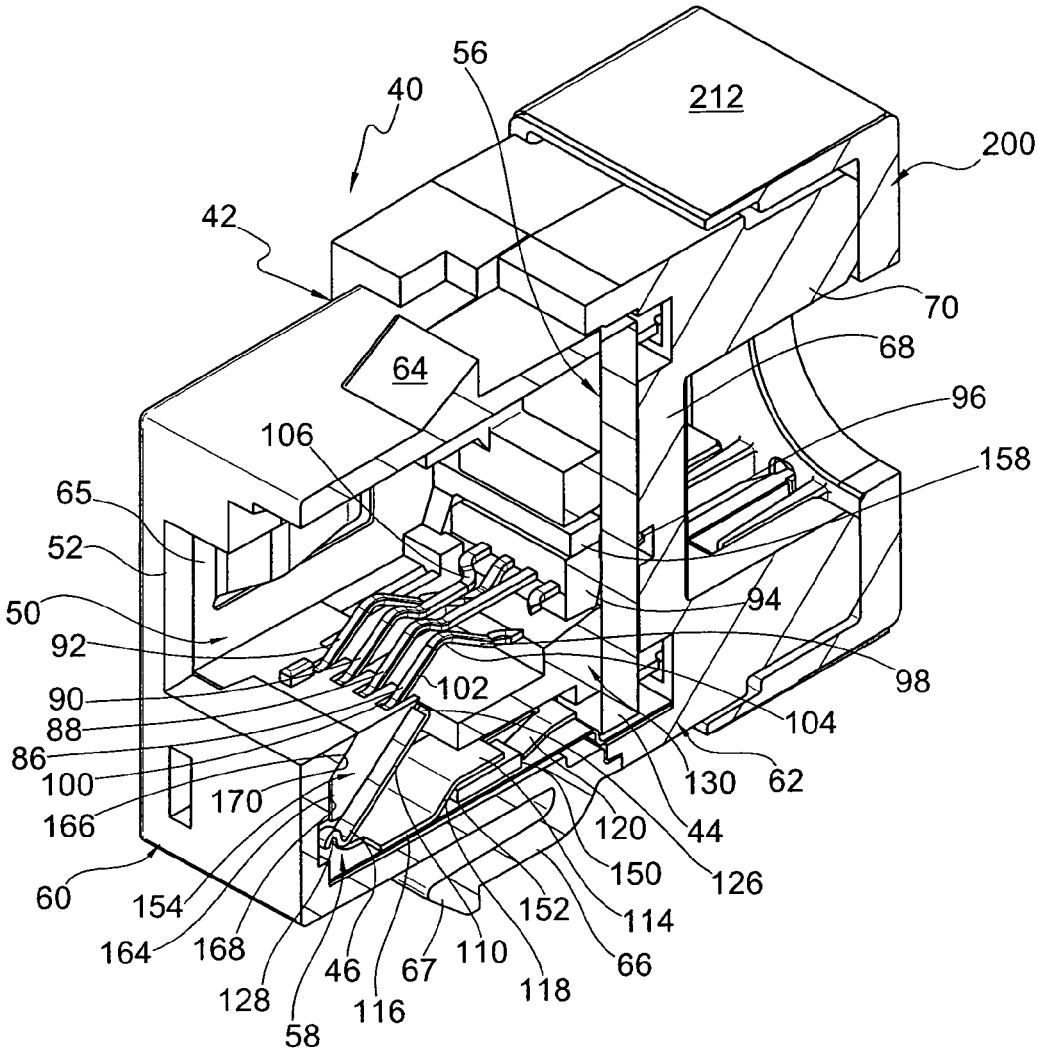
FIG. 4 is a perspective view in section of the electrical connector of FIG. 1.
Figure 5:
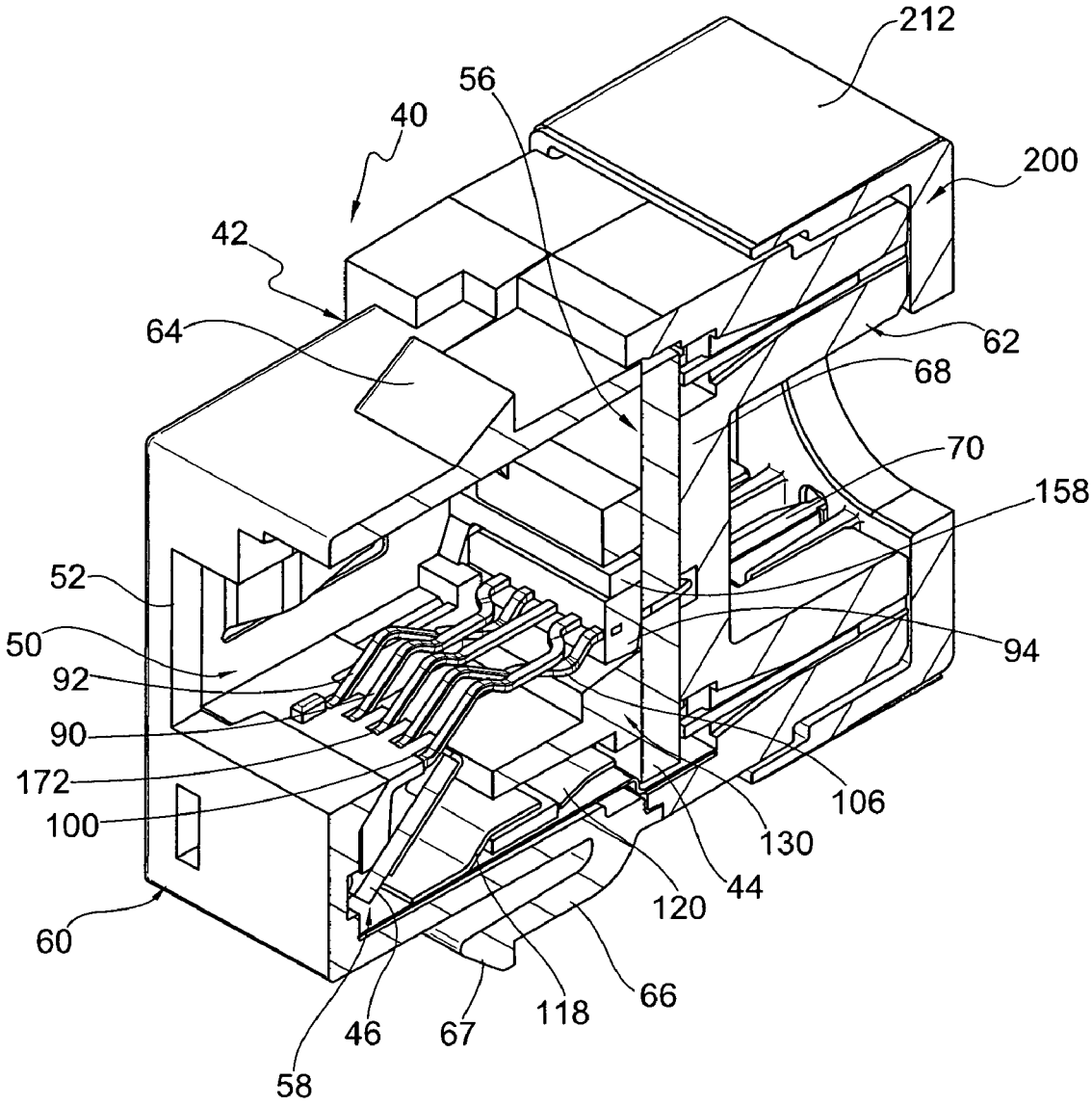
FIG. 5 is another perspective view in section of the electrical connector of FIG. 1 taken in a different, laterally spaced plane from that of FIG. 4.

The interior of the nose housing part is primarily formed of and divided into plug receiving cavity 50 and forward chamber 58. Each of cavity 50 and chamber 58 forms a distinct and separate portion of that interior. An interior shield 65 (FIG. 4) with a metallic, electrically conductive layer covered by insulation can be provided on each inner side surface of the nose housing part.

Insulator housing part 62 (FIG. 13) comprises a rectangular base member 68 and a plurality of posts 70 extending from the base member. Adjacent surfaces of the post have recesses 72 receiving insulation displacement contacts 72 (FIG. 12). The spaces between posts 70 receive wires. Each of the insulation displacement contacts includes an upper portion 74 comprising a pair of spaced members with a slot therebetween for receiving insulated wire in a standard manner and located in the spaces between posts 70. A lower portion 76 depends from upper portion 74 to extend through base member 68 and into mounting circuit board 44. Shoulders 77 can extend laterally from lower sections of upper portions 74, and can engage shoulders in the insulator housing part if pulled out of the mounting circuit board. Mounting circuit board 44 is trapped between insulator housing part 62 and nose housing part 60. In this manner, the insulation displacement contact 72 extends from one surface of mounting circuit board 44. Other orientations of the insulation displacement contacts can be used.

Eight resilient jack contacts 78, 80, 82, 84, 86, 88, 90 and 92 extend from mounting circuit board 44 and from its surface opposite that from which insulation displacement contacts 72 extend. As illustrated in FIGS. 7-11, each jack contact is mounted in and is insulated by an over mold 94 formed of electrically insulating, plastic material. The contacts are formed of basically two shapes, with one shape illustrated in FIG. 7 and the second shape illustrated in FIG. 8. The shape of FIG. 7 is used in the third and sixth jack contacts 82 and 88. The remaining jack contacts are formed generally according to the configuration of FIG. 8, but with the variation in elevation shown in FIG. 11 to provide the crossovers shown in FIG. 9.

First and second jack contacts form a pair with reverse configurations such that the two contacts cross one another without touching. The fourth and fifth contacts cross one another without touching in a similar manner. The seventh and eighth contacts cross another without touching in a similar manner.

Figure 3:
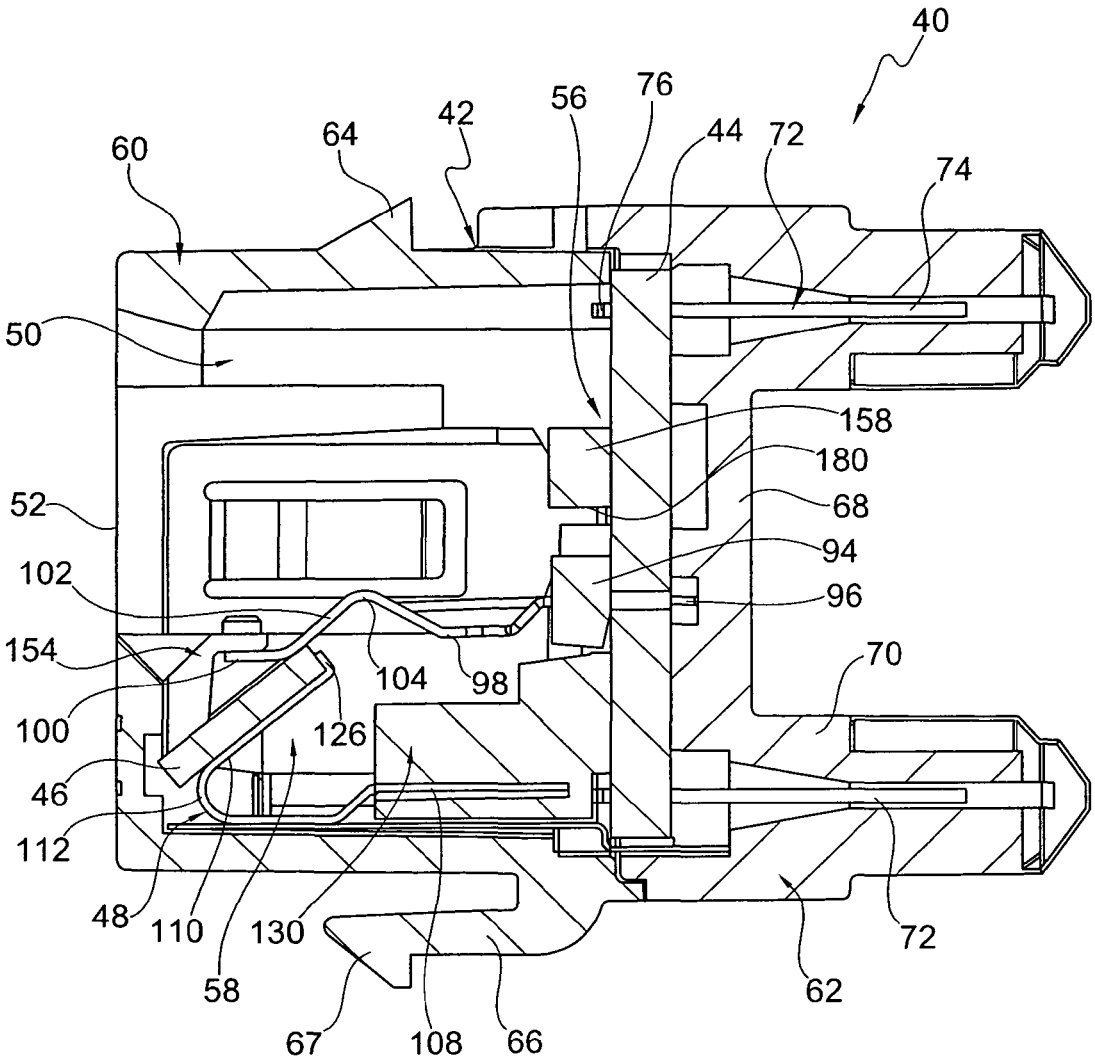
FIG. 3 is a side elevational view in section taken along the line of 3-3 of FIG. 2 of the electrical connector of FIG. 1, without the stuffer cap.

Each of the jack contacts have a mounting end 96 that extends from the over mold and engages mounting circuit board 44. On the opposite side of the over mold, each contact has a plug contacting portion extending from the over mold to a free end 100 between the free end and the over mold. Each jack contact plug contacting portion has a generally V-shaped bent portion 102 defining a plug contacting engagement point 104 at its apex. The plug contacting portion, including the engagement point, extends through plug receiving cavity 42 with the free end extending from the plug receiving cavity into the forward chamber 58. Lateral S-shaped offset bends 106 are provided in the first, second, forth, fifth, seventh and eighth jack contacts adjacent the over mold to provide for the crossovers discussed above. The front part of the V-shaped bent portion extends at an angle to the longitudinal axis of the electrical connector substantially equal to the angle of the compensation circuit board to that longitudinal axis before plug insertion, as shown in FIG. 3, such that such front part is substantially parallel to the compensation circuit board.

Figure 6:
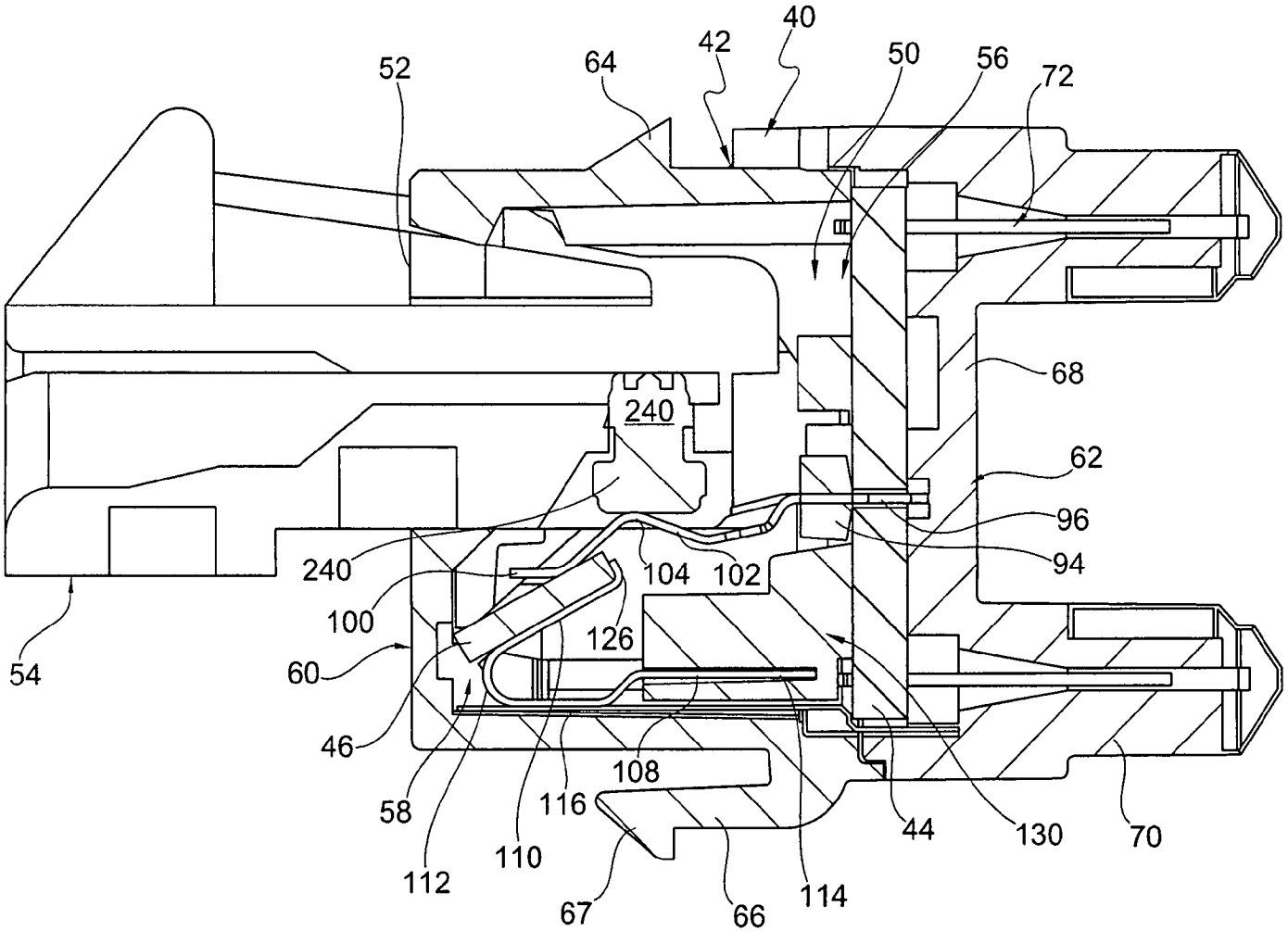
FIG. 6 is a side elevational view in section of the electrical connector of FIG. 1 with a mating plug received therein.
Figure 14:
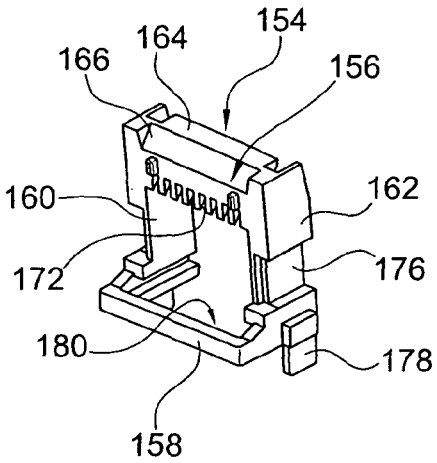
FIG. 14 is a perspective view of a comb insert of the electrical connector of FIG. 1.
Figure 15:
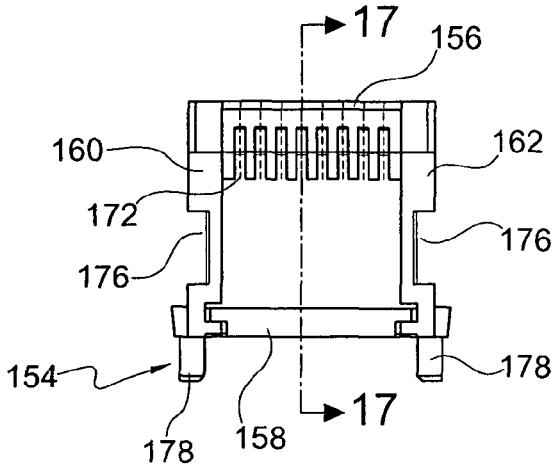
FIG. 15 is a top plan view of the comb insert of FIG. 14.
Figure 16:
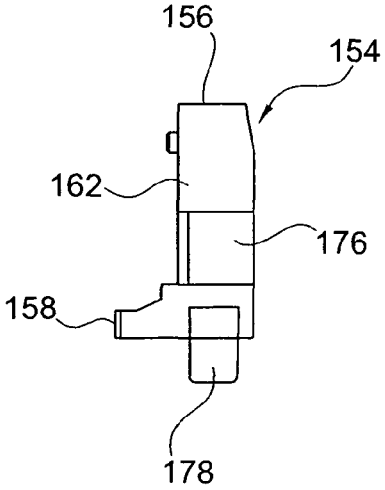
FIG. 16 is a side elevational view of the comb insert of FIG. 14.
Figure 17:
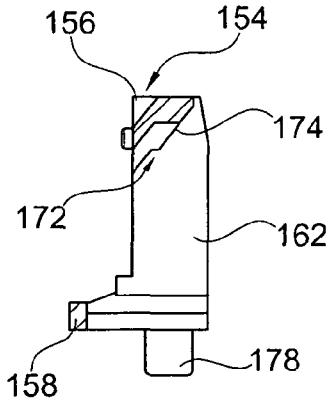
FIG. 17 is a side elevational view in section taken along line 17-17 of FIG. 15 of the comb insert of FIG. 14.
Figure 18:
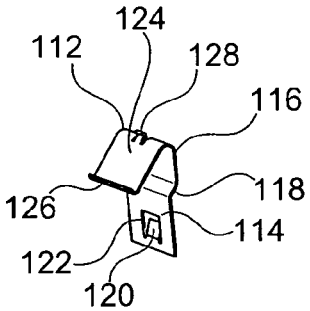
FIG. 18 is a perspective view of the spring of the electrical connector of FIG. 1.
Figure 19:
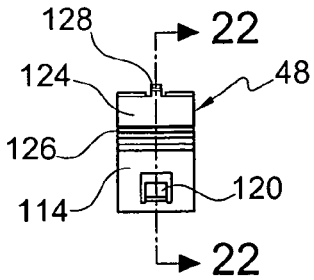
FIG. 19 is a top plan view of the spring of FIG. 18.
Figure 20:
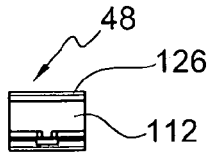
FIG. 20 is a front elevational view of the spring of FIG. 18.
Figure 21:
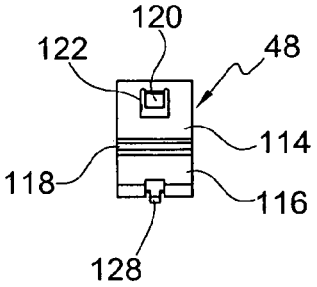
FIG. 21 is a bottom plan view of the spring of FIG. 18.
Figure 22:
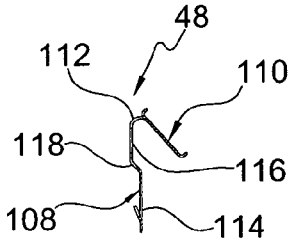
FIG. 22 is a side elevational view in section taken along line 22-22 of FIG. 19 of the spring of FIG. 18.
Figure 23:
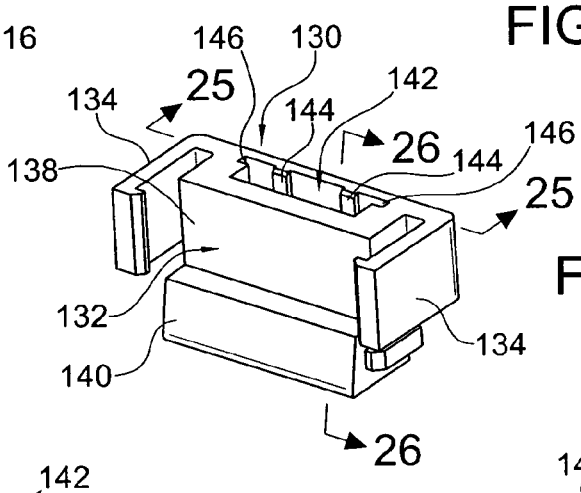
FIG. 23 is a front perspective view of a spring retainer of the electrical connector of FIG. 1.
Figure 24:
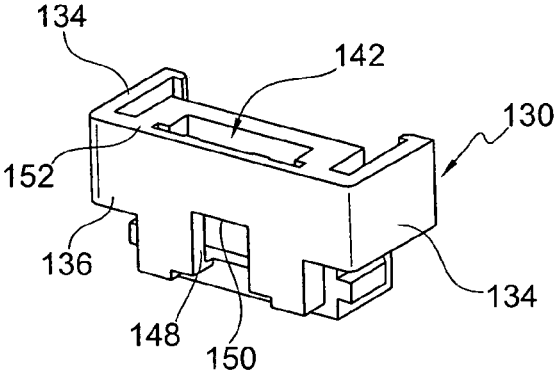
FIG. 24 is a rear perspective view of the spring retainer of FIG. 23.
Figure 25:
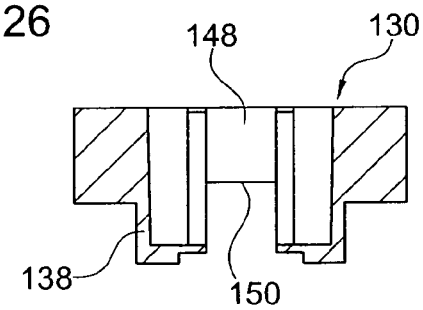
FIG. 25 is a top plan view in section taken along line 25-25 of FIG. 23 of the spring retainer.
Figure 26:
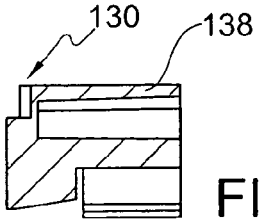
FIG. 26 is a side elevational view in section taken along line 26-26 of FIG. 23 of the spring retainer.

Over mold 94 comprises a rear surface with a perpendicular surface portion 94*a* and an angled surface portion 94*b* oriented at an obtuse angle relative thereto. These surface portions allow over mold 94 to tilt relative to mounting circuit board 44 when plug 54 is inserted and presses on the jack contacts, as shown in FIG. 6. Although an over mold is preferred, the jack contacts can be mounted in a clam shell or other supporting structure.

Compensation board 46 is supported in chamber 58 by spring 48. Spring 48 comprises, as particularly illustrated in FIGS. 18-22, a base leg 108 and an angled leg 110. The two legs are oriented relative to one another at an acute angle of preferably approximately 42 degrees and extend from a bend 112 unitarily connected to the legs. In this manner, the entire spring is formed unitarily of a single piece of resilient metal.

Base leg 108 includes two parts 114 and 116, with part 114 located closer to bend 112 than part 116. The parts extend parallel to one another and are laterally offset by an angularly oriented intermediate leg part 118. Base leg part 114 includes a resilient tang formed in an opening 122. Tang 120 is oriented in a plane at an acute angle relative to the plane of the remainder of base leg part 114, and extends forwardly in the electrical connector. The free end of tang 114 and a surface of intermediate leg part 118 face another at a predetermined distance for securing spring 48 within forward chamber 58, as explained in detail hereinafter.

Angled leg 110 includes a substantially rectangular main portion 124 underlying a bottom surface of compensation board 46 and substantially rectangular end portions 126 and 128. These end portions engage the opposite ends of compensation circuit board 46, with end portion 126 extending from a free end of angled leg 110 and end portion 128 being adjacent bend 112 connecting base leg 108 and angled leg 110. End portion 126 is substantially perpendicular to the plane of main portion 124, and extends along the entire width of the base portion. End portion 128 is formed from an opening in the bend and extends substantially perpendicular to the plane of main portion 124. Both end portions extend from the main portion in the same direction, providing abutments to engage the opposite ends of the compensation circuit board.

A unitarily formed, one piece spring retainer 130, illustrated separately in FIGS. 23-26, is located in forward chamber 58, and comprises a central member 132 and latch arms 134 on the sides of the central member. The bottom surface 136 of central member 132 is substantially planar while its upper surface comprises a planar portion 138 and an angled step 140. Latch arms 134 are laterally adjacent planar portion 138, while angled step 140 is axially spaced or offset from latch arms 134. A generally T-shaped passage 142 extends through central member 132 for receiving spring 148, particularly its base leg part 114. Base leg part 114 rests on ribs 144 extending longitudinally through passage 142, with the lateral side edges of leg part 114 received within the reduced width portions 146 of passage 142.

An axially extending, rectangular slot 148 is formed in the bottom surface 136 and opens into laterally or vertically passage 142. This slot defines an axially facing, rectangular end abutment 150 axially spaced from front surface 152 of central member 132. The axial spacing between abutment 150 and front surface 152 corresponds to the spacing between the free end of tang 120 and intermediate leg part 118 of spring 48. When spring 48 and spring retainer 130 are coupled, the free end of tang 120 engages abutment 150, while intermediate leg part 118 engages an edge of front surface 152 to prevent relative axial movement between the spring and the spring retainer. The spring is mounted in the spring retainer by sliding the free end of leg part 114 into passage 142 from front surface 152. Tang 120 is received in opening 122 until the free end of the tang is freed to move resiliently laterally into an engagement with end abutment 150 by entering slot 148.

Also located within forward chamber 58 of nose housing part 60 is a comb insert 154, illustrated separately in FIGS. 14-17. The comb insert comprises end parts 156 and 158 and side parts 160 and 162 joined in a generally square shape. When positioned in nose housing part 60, end part 156 is located adjacent open end 52 of plug receiving cavity 50. The forward surface 164 of forward end part 156 has a planar surface 164 and an angled surface 166. Forward surface 164 and angled surface 166 engage flat surface 168 and angled surface 170, respectively, of nose housing part 60. Flat surface 168 and angle surface 170 define a forward end of forward chamber 58. The rear end of forward end part has a plurality of axially and rearwardly opening slots 170 with base surfaces extending at an acute angle to the longitudinal axis. These slots receive the free end portions of the jack contacts to maintain the jack contacts in their proper position parallel to one another and separated from one another so as to be in a proper position for engaging the contacts on plug 54, to prevent inadvertent electrical connections of the various jack contacts, and to preload or press the free ends of the jack contacts against compensation circuit board 46.

Side parts 160 and 162 extend parallel to the longitudinal axis of electrical connector 40, and contain laterally outwardly opening, rectangular recesses 176. The recesses receive and engage latch arms 134 connecting spring retainer 130 to comb insert 154. Axially and rearwardly extending, generally rectangular end portions 178 of the side parts abut the surface of mounting circuit board 44. Rear end part 158 is spaced laterally above the side parts and joins the rear ends of side parts 160 and 162 adjacent end parts 178. In this manner, rear end part 158 is spaced axially and laterally relative to front end part 156, and defines a recess 180 that in the assembled position illustrated in FIGS. 3 and 4 receives over mold 94.

Figure 27:
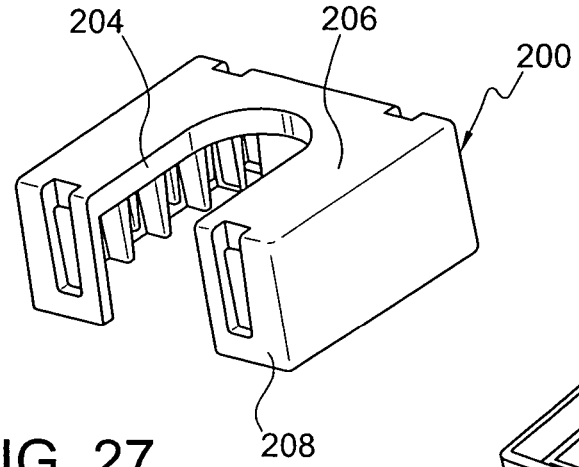
FIG. 27 is a top perspective view of the stuffer cap of the electrical connector of FIG. 1.
Figure 28:
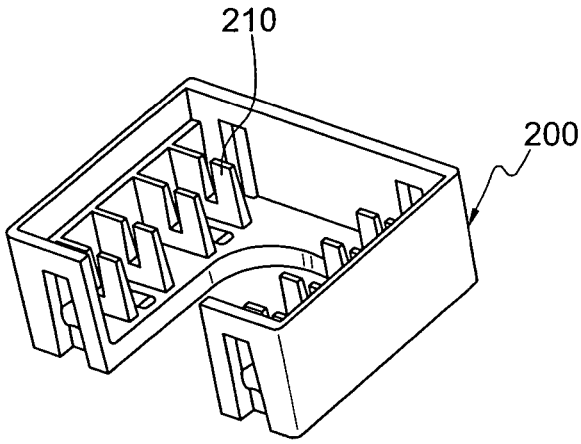
FIG. 28 is a bottom perspective view of the stuffer cap of FIG. 27.

A stuffer cap of generally conventional design is provided to cover the insulation displacement contacts and the free end of insulator housing part 62 and to force wires into those insulation displacement contacts. The general configuration of the stuffer cap is adequately illustrated in FIGS. 27 and 28. Basically, the stuffer cap comprises a cap housing 202 with five walls and a slot 204 in the top wall 206 and the front wall 208. Plural slotted projections 210 extend parallel to one another from the inner surface of top wall 206. The bottom end of the stuffer cap is open for mounting over the free end of insulator housing part 62, with projections 210 extending in the spaces between adjacent posts 70.

Figure 29:
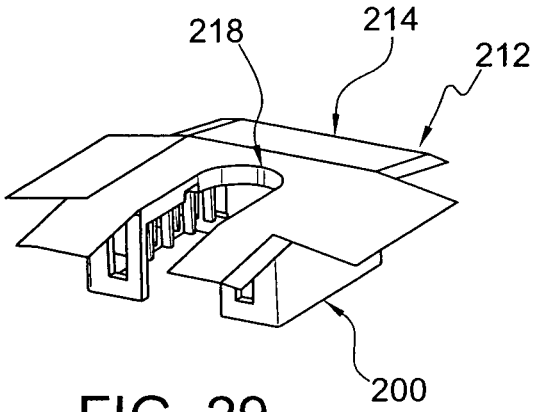
FIGS. 29-31 are top perspective views of the stuffer cap with the foil shield being added in various stages of production thereof.
Figure 30:
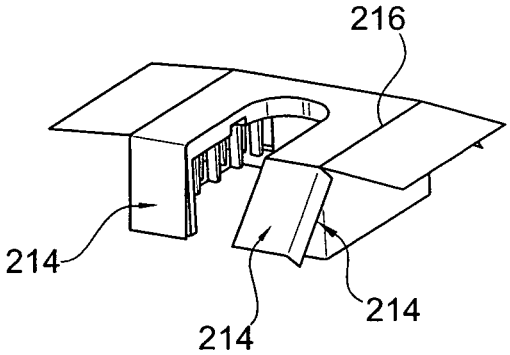
Figure 31:
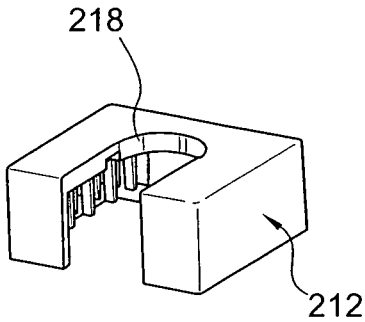

A shield 212 with an electrically conductive metallic internal layer is mounted on the exterior surfaces of the stuffer cap walls. The configuration of the shield is mated to conform to and adhere to the configuration of the stuffer cap walls. The shield includes a plurality of tabs 214 connected by fold lines 216. The tabs also include a slot 218 conforming to the configuration of slot 204. The mounting of the shield on the outer surface of the stuffer cap is apparent from the illustrations of FIGS. 29-31, and thus, is not explained in further detail. The outer surface of the shield is not conductive so that adjacent jacks do not create harmonics.

Figure 32:
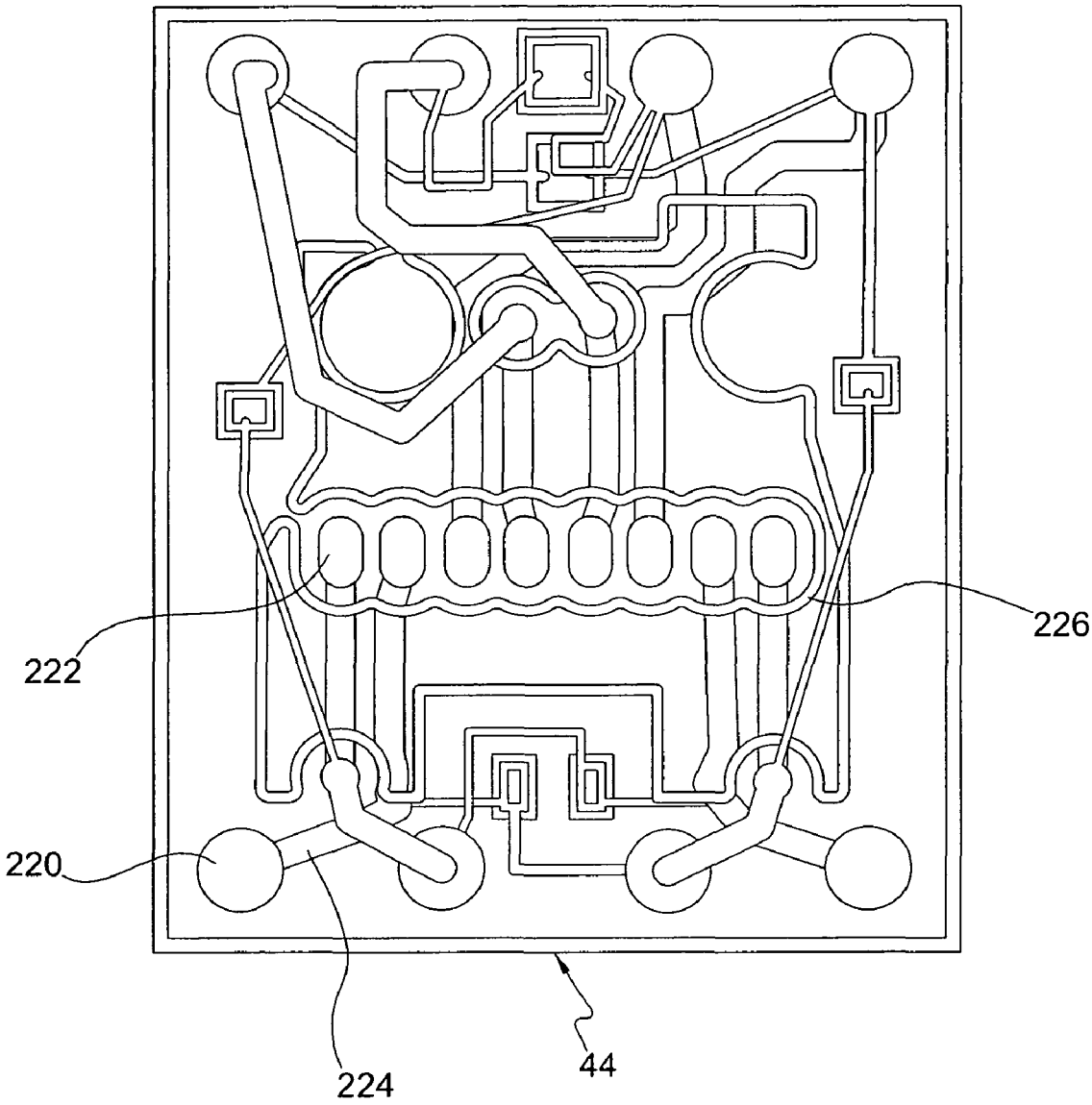
FIG. 32 is a circuit diagram of the mounting circuit board of the electrical connector of FIG. 1.

The electrical circuitry on mounting circuit board 44 is graphically depicted in FIG. 32. This circuitry electrically couples the jack contacts to the insulation displacement contacts. This circuit includes IDC contact pads 220 and jack contact pads 222. The mounting circuit board 44 can be formed in various layers, with the appropriate electrically conductive traces 224 connecting the respective IDC contact pads with the respective jack contact pads. The conductive traces pass over one another to be electrically insulated from one another in a manner that would be readily recognized by one skilled in this art. Compensation circuitry can be provided on the mounting circuit board, along with a ground plane plate 226 for controlling differential and common mode impedance. Controlling common mode impedance to match with the cable's common mode impedance improves reducing common mode reflections and the resulting excess alien crosstalk coupling between channels.

Three layouts for the electrical circuitry of the compensation circuit board are graphically illustrated in FIGS. 33A-C and 34A-C, with the three layouts being FIGS. 33A and 34B, FIGS. 33B and 34B and FIGS. 33C and 34C. The layouts employ the same compensation scheme, but with varying amounts of capacitive and inductive coupling for crosstalk compensation. Each compensation layout includes elongated conductive jack contact pads 250 adjacent one edge of the top surface of the compensation circuit board, generally rectangular compensation plates 252 on each of the opposite surfaces of the compensation circuit board, and conductive traces extending between and electrically connecting the respective contact pads 250 and the respective compensation plates 252. Portions of the contact pads extend through the compensation board to its bottom surface, as particularly shown in FIGS. 34A-C. The contact pads are engaged by the free ends of the jack contacts. The size and relative positions of the compensation plates provides the appropriate capacitive and inductive couplings for the cancellation of crosstalk induced in other portions of the electrical connector.

The assembled connector is illustrated in FIGS. 1-5. Mounting circuit board 44 with the jack contacts and the insulation displacement contacts extending from opposite surfaces of that board is mounted between nose housing part 16 and insulator housing part 62. The insulation displacement contacts extend through the insulator housing part, while the jack contacts extends through plug receiving cavity 50 and out of that cavity into forward chamber 58 to engage contact pads 250 on compensation circuit board 46. Spring retainer 130 and insert comb 154, along with spring 48 and compensation circuit board 46, are mounted in forward chamber 58, and are connected to one another, as described above. Wires are engaged with the insulation displacement contacts in the conventional manner by being placed between the posts, and are forced into engagement with the insulation displacement contacts, and then covered by stuffer cap 200.

FIG. 6 illustrates the insertion of plug 54 into and mating with electrical connector 40. When plug 54 is inserted into cavity 50 of the electrical connector, the respective plug contacts 240 engage the respective jack contacts. In the orientation of FIG. 6, the jack contacts are pushed downwardly with their free ends 100 caused to sweep or slide on and enhance the electrical connections with contact pads 250 on compensation circuit board 46. The configurations, dimensions and resiliency of the jack contacts are controlled to provide this sweeping or sliding engagement. The jack contact free ends move relative to the conductive pads 250 on the compensation board to improve the connection. As the jack contacts are pressed downwardly, the compensation circuit board essentially pivots downwardly with angled leg 110 of the spring 48 about a pivot point defined by the spring bend portion 102. The flexing of the spring and of the compensation circuit board allows the spring 48 to take a portion of the stress or forces generated by the insertion of plug 54 into plug receiving cavity 50 of connector 40 to avoid overstressing of the jack contacts. By preventing overstressing, repeated connections and disconnections of plug 54 and electrical connector 40 can be performed while maintaining the integrity of the connection.

Engagement points 104 on the jack contacts provide a predetermined and set location for the engagement of the plug contacts with the jack contacts. This engagement point is located close to the compensation circuitry on the compensation circuit board. This arrangement, in combination with the positioning of the jack contacts maintained by the comb insert, allows the predetermined and high degree of effectiveness using a minimal amount of compensation for reducing crosstalk through the plug and the electrical connector. Minimizing the amount of corrective coupling improves maintaining connector balance and maintaining high frequency Return Loss (impedance) performance.

Compensation circuit board 46 and the free ends of the jack contacts are parallel in the unmated state (FIG. 3). The preload induced in spring 48 biases the compensation circuit board towards the free ends of the contacts, ensuring that the compensation circuit board and the free ends of the contacts are parallel in spite of dimensional and manufacturing variations.

The angle of the compensation circuit board is dependent on angled leg 110 of spring 44. The angled leg of the spring is approximately parallel to the free ends of the contacts to reduce stress in the jack contacts at and beyond the plug mating point.

The angle of the compensation circuit board is also parallel to the free ends of the jack contacts to create the shortest electrical path from the plug mating point to the point of primary compensation on compensation board 46. If the compensation circuit board is mounted at an angle that is different than the angle of the free ends of the jack contacts, the electrical path is increased.

The term "wipe" describes the distance that the jack contact travels along the conductive pads on the compensation circuit board during plug insertion. The angle of spring 48 relative to the angle of the free ends of the jack contacts promotes an adequate "wipe" before spring deflection occurs forward of over mold 94. If deflection of the spring is immediate, the amount of "wipe" is reduced. If the amount of "wipe" is reduced, corrosive buildup on the jack contacts or the conductive pads will not be removed during plug insertion, and all eight contacts will not be in contact with the compensation circuit board after plug insertion.

The strength of the jack contacts relative to the strength of the spring ensures that all eight jack contacts are always in contact with the compensation circuit board after plug insertion. Each individual jack contact must generate a force on compensation circuit board 46 less than ten percent of the force generated by spring 48 over the same deflection distance on the compensation circuit board.

Figure 35:
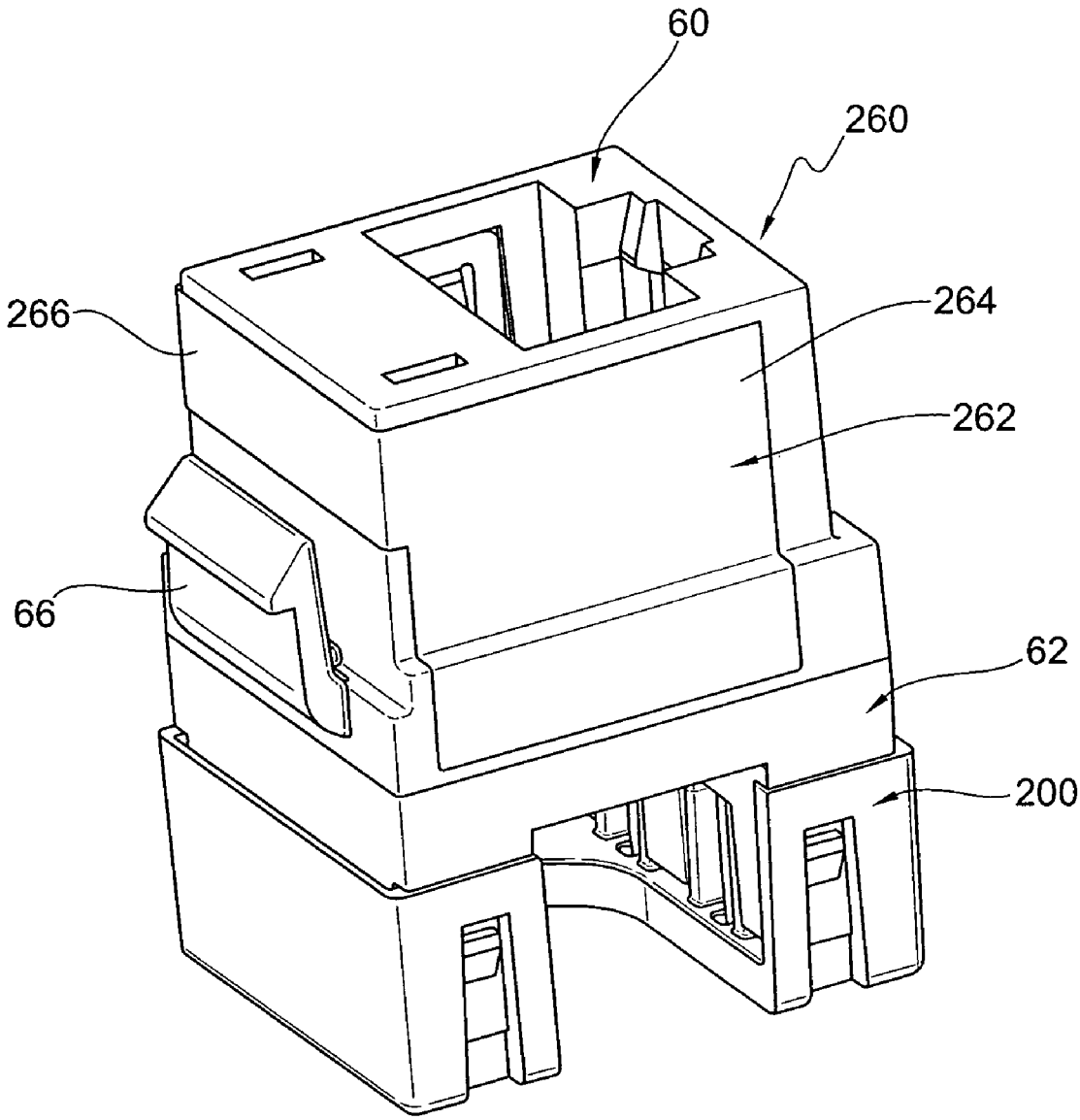
FIG. 35 is a perspective view of an electrical connector according to a second exemplary embodiment of the present invention.

An electrical connector 260 according to a second exemplary embodiment of the present invention is illustrated in FIG. 35. Electrical connector 260 differs from the electrical connector 40 solely by the addition of metallic shielding 262. Metallic shielding 262 comprises two substantially identical, rectangular side members 264 on each side surface of nose housing part 60 and a rectangular bottom member 266 on a generally rectangular bottom surface of the nose housing part adjacent latch arm 66. Bottom member 266 extends between and connects the two side members 264. The size and configuration of the shielding members conforms to the sizes and configurations of the respective surfaces of the nose housing part.

Figure 36:
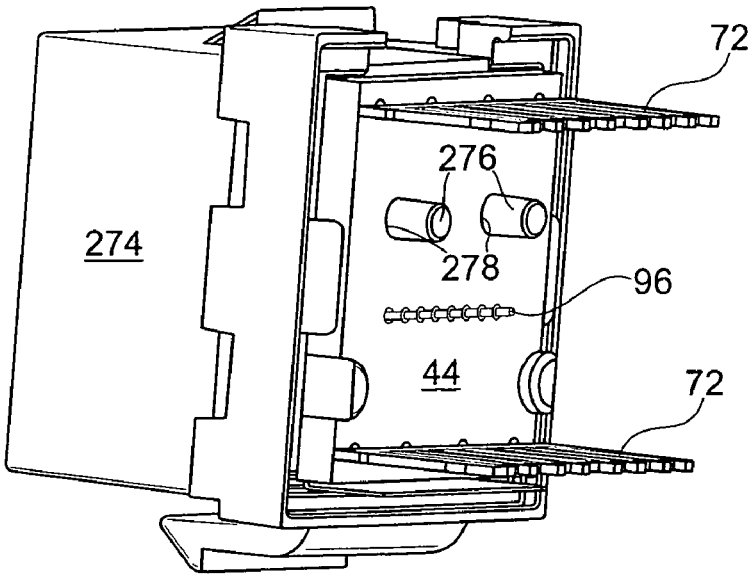
FIG. 36 is a rear perspective view of an electrical connector, without the insulator housing part and stuffer cap, according to a third exemplary embodiment of the present invention prior to deformation of the collapsible members.
Figure 37:
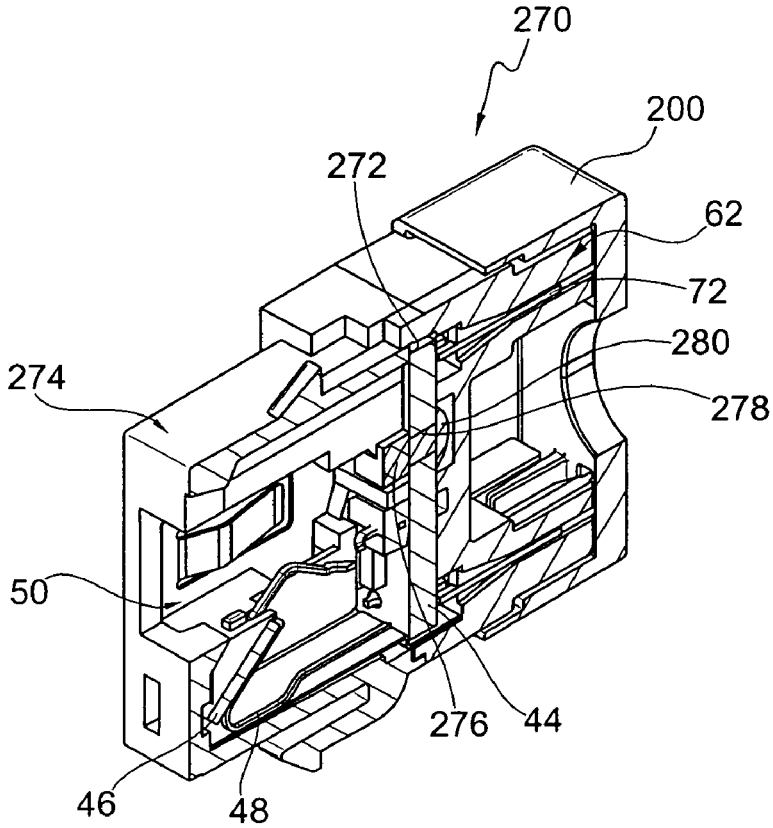
FIG. 37 is a front perspective view in section of the electrical connector of FIG. 36 after deformation of the collapsible members.

FIGS. 36 and 37 show an electrical connector 270 according to a third embodiment of the present invention in which mounting circuit board 44 is pressed against and maintained in position against rear surface 272 of nose housing part 274. At least one and preferably at least two plastic cylindrical projections 276 extend from rear surface 272 and through mate openings 278 in mounting circuit board 47. Projections 276 are ultrasonically welded or heat staked as the mounting circuit board is pressed against nose housing part rear surface 272 to form mushroom-shaped heads 280 and to secure the mounting board in its proper position in the housing part. This arrangement eliminates tolerance stack-up, and allows for minimal variability. The moldable projections could be replaced with screws.

An electrical connect or 290 according to a fourth exemplary embodiment of the present invention is illustrated in FIGS. 38 and 39. Electrical connector 290 differs from the electrical connector 40 solely by the addition of metallic shielding 292. Metallic shielding 292 comprises two substantially identical, rectangular front side members 294 on each side surface of nose housing part 60, two substantially identical, rectangular rear side members 296 on the nose housing part and insulator housing part 62, and a rectangular back member 298 on a generally rectangular back surface of the insulator housing part between posts 70. Back member 298 extends between and is connected to the two rear side members 296 by fold lines. Each front side member 294 is connected to a respective rear side member 296 by a pair of tabs 302 with fold lines 304. The size and configuration of the shielding members conforms to the sizes and configurations of the respective surfaces of the housing parts.

While several embodiments have been chosen to illustrate the invention, it will be understood by those skilled in the art that various changes and modifications can be made therein without departing from the scope of the invention as defined in the appended claims.

What is claimed is:

1. An electrical connector, comprising:

a housing having a plug receiving cavity with an open end for receiving a plug and with an inner end spaced from said open end, and having a forward chamber outside of said cavity and adjacent said open end;

a mounting circuit board in said housing adjacent said inner end;

a plurality of pairs of electrical jack contacts, each of said jack contacts having a mounting end engaging said mounting circuit board, a plug contacting portion extending through said cavity from said mounting end toward said open end, and a free end extending from said contacting portion into said forward chamber;

a compensation circuit board mounted in said forward chamber of said housing outside of said plug receiving cavity having a compensation circuit thereon with conductive pads, said free ends of said jack contacts engaging said conductive pads; and a spring in said forward chamber biasing said compensation circuit board towards said free ends of said jack contacts.

2. An electrical connector according to claim 1 wherein said spring comprises a base leg engaging said housing and an angled leg engaging said compensation circuit board.

3. An electrical connector according to claim 2 wherein said angled leg is acutely angled relative to said base leg.

4. An electrical connector according to claim 2 wherein said angled leg and said base leg extend from a bend unitarily connected to said legs.

5. An electrical connector according to claim 2 wherein said angled leg comprises a main portion underlying a bottom of said compensation circuit board and two end portions extending from said main portion and engaging opposite ends of said compensation circuit board.

6. An electrical connector according to claim 5 wherein said end portions extend from said main portion adjacent a free end of said angled leg and adjacent an end of said angled leg connected to said base leg.

7. An electrical connector according to claim 2 wherein said housing comprises a nose housing part defining said cavity and said forward chamber, said nose housing part having a spring retainer in said forward chamber with oppositely directed abutments; and said base leg comprises a resilient tang and a shoulder engaging said abutments to restrain movement of said spring.

8. An electrical connector according to claim 1 wherein each of said jack contacts comprises a bend forming a plug contact engagement point, said engagement point being closer to said free end than said mounting end on each said jack contact.

9. An electrical connector according to claim 1 wherein insulation displacement contacts extend from a surface of said mounting circuit board opposite to a surface thereof from which said jack contacts extend, said mounting circuit board having conductive traces connecting the respective jack contacts and the respective insulation displacement contacts.

10. An electrical connector according to claim 9 wherein said insulation displacement contacts are mounted in an insulator housing part of said housing, and are covered by a stuffer cap having an electrically conductive shield on an outer surface thereof.

11. An electrical connector according to claim 1 wherein said plug receiving cavity has a longitudinal axis extending from said open end to said inner end; and said compensation circuit board extends at an acute angle relative to said longitudinal axis.

12. An electrical connector according to claim 11 wherein said acute angle is approximately 40 degrees.

13. An electrical connector according to claim 1 wherein said housing comprises a comb insert adjacent said open end and having slots opening toward said inner end through which said free ends of said jack contacts extend.

14. An electrical connector according to claim 1 wherein said jack contacts extend from an over mold in one direction into said cavity and in an opposite direct to engage said mounting circuit board.

15. An electrical connector according to claim 1 wherein said jack contacts comprise first, second, third, fourth, fifth, sixth, seventh and eighth contacts in an ordered array, said first and second contacts crossing one another without touching, said fourth and fifth contacts crossing one another without touching and said seventh and eighth contact crossing one another without touching, said third and sixth contacts extend through said cavity without crossing another of said jack contacts.

16. An electrical connector according to claim 1 wherein said jack contacts are insulated from one another by being mounted in and connected by an over mold.

17. An electrical connector according to claim 1 wherein each of said jack contacts comprises a generally V-shaped bend forming a plug engagement point at an apex thereof with a forward portion of said bend extending at an angle substantially equal to an angular orientation of said compensation circuit board such that said forward portion and said compensation circuit board are substantially parallel.

18. An electrical connector according to claim 1 wherein said housing comprises a nose housing part having at least one projection extending rearwardly from a rear surface of said nose housing part and through an opening in said mounting circuit board, said projection pressing said mounting circuit board against said rear surface.

19. An electrical connector according to claim 1 wherein said mounting circuit board includes a ground plane plate adjacent electrical conductive traces on said mounting circuit board connecting said jack contacts with insulation displacement contacts coupled to said mounting circuit board, said ground plane plate controlling and altering common and differential mode impedance in a predetermined manner.

20. An electrical connector according to claim 1 wherein each of said jack contacts generates a force on said compensation circuit board less than ten percent of a force generated by said spring on said compensation circuit board.

21. An electrical connector, comprising:

a housing having a plug receiving cavity with an open end for receiving a plug and with an inner end spaced from said open end, having a forward chamber outside of said cavity and adjacent said open end and having insulator housing part, said cavity having a longitudinal axis extending from said open end to said inner end;

a mounting circuit board mounted in said housing adjacent said inner end and having conductive traces thereon;

a plurality of pairs of resilient electrical jack contacts, each of said jack contacts having a mounting end engaging said mounting circuit board, a plug contacting portion extending through said cavity from said mounting end toward said open end, and a free end extending from said contacting portion into said forward chamber, each of said jack contacts having a bend forming a plug contact engagement point closer to said free end than said mounting end thereof, said jack contacts including first, second, third, fourth, fifth, sixth, seventh and eighth contacts in an ordered array, said first and second contacts crossing one another without touching, said fourth and fifth contacts crossing one another without touching and said seventh and eighth contact crossing one another without touching, said third and sixth contacts extending through said cavity without crossing another of said jack contacts, said jack contacts being insulated from one another by being mounted in and connected by an over mold;

a compensation circuit board mounted in said forward chamber at an acute angle to said longitudinal axis and outside of said plug receiving cavity, said compensation circuit board having a compensation circuit thereon with conductive pads, said free ends of said jack contacts engaging said conductive pads;

a spring in said forward chamber biasing said compensation circuit board towards said free ends of said jack contacts, said spring having a base leg engaging said housing and an angled leg engaging said compensation circuit board, said angled leg being acutely angled relative to said base leg, said angled leg and said base leg extending from a bend unitarily connected to said legs;

insulation displacement contacts being mounted in an insulator housing part and extending from a surface of said mounting circuit board opposite to a surface thereof from which said jack contacts extend, said conductive traces connecting the respective jack contacts and the respective insulation displacement contacts;

a stuffer cap having an electrically conductive shield on an outer surface thereof, engaging said insulator housing part and covering said insulation displacement contacts; and a comb insert in said housing adjacent said open end and having slots opening toward said inner end receiving said free ends of said jack contacts.

22. An electrical connector according to claim 21 wherein said angled leg comprises a main portion underlying a bottom of said compensation circuit board and two end portions extending from said main portion and engaging opposite ends of said compensation circuit board.

23. An electrical connector according to claim 22 wherein said end portions extend from said main portion adjacent a free end of said angled leg and adjacent an end of said angled leg connected to said base leg.

24. An electrical connector according to claim 22 wherein said housing comprises a nose housing part defining said plug receiving cavity and said forward chamber, said nose housing part having a spring retainer therein with oppositely directed abutments; and said base leg comprises a resilient tang and a shoulder engaging said abutments to restrain movement of said spring.

* * * * *